US008668528B2

(12) United States Patent
Rothkopf et al.

(10) Patent No.: US 8,668,528 B2
(45) Date of Patent: Mar. 11, 2014

(54) SPLIT JACK ASSEMBLIES AND METHODS FOR MAKING THE SAME

(71) Applicant: Apple Inc., Cupertino, CA (US)

(72) Inventors: Fletcher R. Rothkopf, Los Altos, CA (US); Anna-Katrina Shedletsky, Sunnyvale, CA (US); Ian P. Colahan, Menlo Park, CA (US); Daniele De Iuliis, San Francisco, CA (US); Trent K. Do, Milpitas, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/631,553

(22) Filed: Sep. 28, 2012

(65) Prior Publication Data

US 2013/0109248 A1 May 2, 2013

Related U.S. Application Data

(60) Provisional application No. 61/555,131, filed on Nov. 3, 2011, provisional application No. 61/553,109, filed on Oct. 28, 2011.

(51) Int. Cl.
*H01R 24/04* (2006.01)

(52) U.S. Cl.
USPC ..... 439/669; 439/786

(58) Field of Classification Search
USPC ..... 439/668, 669, 786
See application file for complete search history.

(56) References Cited

U.S. PATENT DOCUMENTS

| | | | | |
|---|---|---|---|---|
| 419,365 | A * | 1/1890 | Seely | 174/71 R |
| 5,181,859 | A | 1/1993 | Foreman et al. | |
| 6,991,497 | B1 | 1/2006 | Lin | |
| 7,112,099 | B2 | 9/2006 | Ma | |
| 7,371,125 | B2 | 5/2008 | McHugh et al. | |
| 7,717,755 | B2 | 5/2010 | Zhang et al. | |
| 7,988,498 | B1 | 8/2011 | Lim et al. | |
| 8,123,569 | B2 | 2/2012 | Little et al. | |
| 8,215,989 | B2 | 7/2012 | Tamm et al. | |
| 8,360,801 | B2 * | 1/2013 | Lynch et al. | 439/488 |
| 2008/0032562 | A1 | 2/2008 | McHugh et al. | |
| 2009/0239424 | A1 * | 9/2009 | Maschke et al. | 439/786 |
| 2010/0024025 | A1 | 1/2010 | Yoshida et al. | |
| 2010/0240259 | A1 * | 9/2010 | Murphy et al. | 439/668 |
| 2012/0196459 | A1 * | 8/2012 | Hartmann | 439/116 |
| 2013/0075149 | A1 * | 3/2013 | Golko et al. | 174/359 |
| 2013/0084736 | A1 | 4/2013 | Strittmatter et al. | |
| 2013/0109248 | A1 * | 5/2013 | Rothkopf et al. | 439/786 |

* cited by examiner

*Primary Examiner* — James Harvey

(57) ABSTRACT

Split jack assemblies are constructed with a tubeless pin block. Elimination (or split) of the tube, or more particularly, a tube that is an integrally formed part of the pin block form the pin block allows for the use of a tubeless pin block design that results in a jack assembly having smaller overall dimensions than a conventional jack assembly constructed to accommodate a plug of the same dimensions. The tubeless pin block can be used in conjunction with a tube sleeve or with a curved surface of a housing for an electronic device, or both to provide a plug receptacle of the split jack assembly.

20 Claims, 8 Drawing Sheets

SPLIT JACK ASSEMBLIES AND METHODS FOR MAKING THE SAME

CROSS-REFERENCE TO RELATED APPLICATION

This application claims the benefit of U.S. Provisional Application No. 61/553,109, filed Oct. 28, 2011, and U.S. Provisional Application No. 61/555,131, filed Nov. 3, 2011, the disclosures of which are incorporated by reference herein in their entireties.

BACKGROUND OF THE INVENTION

This disclosure is directed to split jack assemblies and methods for making the same.

Electronic devices may include jacks into which plugs may be inserted. The jack can include a number of contacts that come into contact with the plug when it is inserted into the jack. When inserted, signals can be transmitted between the plug and the jack. For example, an electronic device can generate audio signals that are provided from the jack to the plug, or the jack can receive microphone signals from the plug. As the size of electronic devices continue to shrink, and more features requiring more circuitry are incorporated therein, an ever increasing premium is made on space. Since the jack is often a necessary component included in electronic devices, there is a need for jacks having a reduced footprint.

SUMMARY OF THE DISCLOSURE

This disclosure is directed to split jack assemblies and methods for making the same. Split jack assemblies according to embodiments of the invention are constructed with a tubeless pin block. Elimination (or split) of the tube, or more particularly, a tube that is an integrally formed part of the pin block form the pin block allows for the use of a tubeless pin block design that results in a jack assembly having smaller overall dimensions than a conventional jack assembly constructed to accommodate a plug of the same dimensions. The tubeless pin block can be used in conjunction with a tube sleeve or with a curved surface of a housing for an electronic device, or both to provide a plug receptacle region of the split jack assembly.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION

Split jack assemblies according to various embodiments are constructed with a tubeless pin block. Elimination (or split) of the tube, or more particularly, a tube that is an integrally formed part of the pin block form the pin block allows for the use of a tubeless pin block design that results in a jack assembly having smaller overall dimensions than a conventional jack assembly constructed to accommodate a plug of the same dimensions. The tubeless pin block can be used in conjunction with a tube sleeve or with a curved surface of a housing for an electronic device, or both to provide a plug receptacle region of the split jack assembly.

Figure 1A:
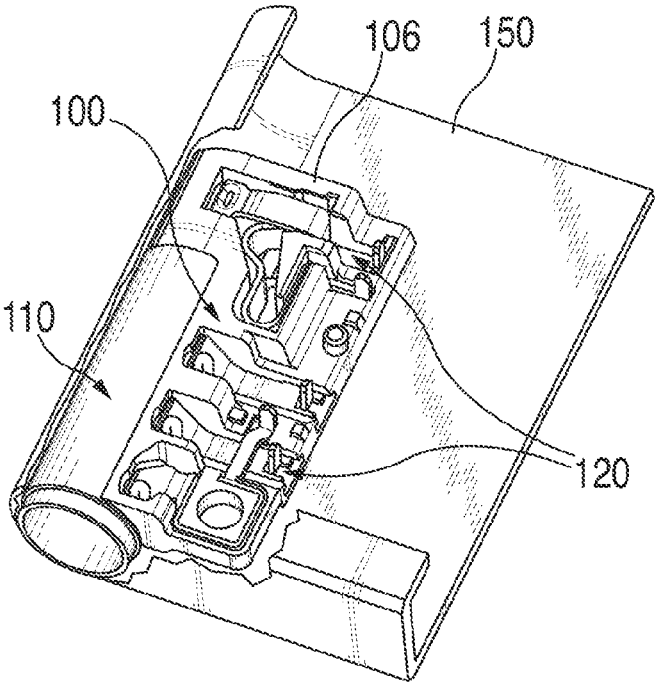
FIG. 1A (PRIOR ART)
FIGS. 1A-1C show several illustrative views of a conventional integrated-tube jack assembly.
Figure 1B:
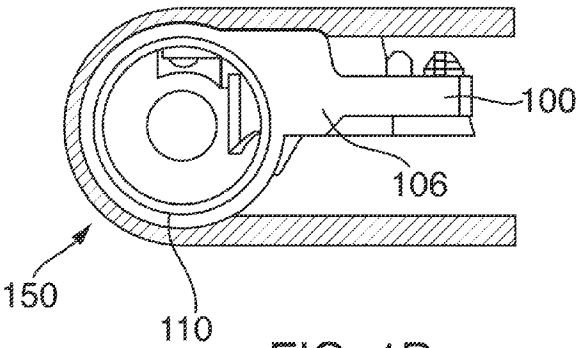
FIG. 1B (PRIOR ART)
Figure 1C:
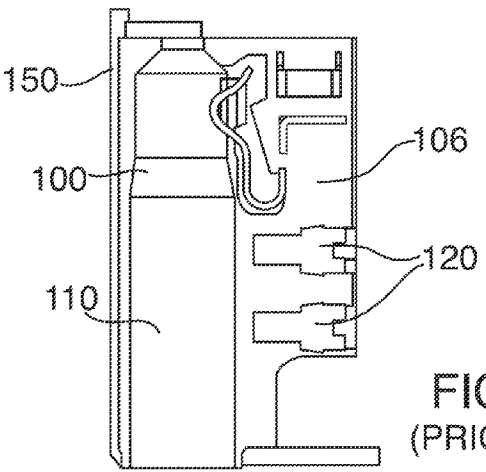
FIG. 1C (PRIOR ART)

Referring to FIGS. 1A-1C, several illustrative views of a conventional integrated-tube jack assembly are shown. FIG. 1A shows an illustrative partial cut-way and isometric view of integrated-tube jack assembly 100 incorporated into housing 150. FIG. 1B shows a side view and FIG. 1C shows a top view of jack assembly 100 in housing 150, respectively. Reference will be made to FIGS. 1A-1C collectively. As shown, jack assembly 100 includes a non-conductive component and several conductive components. The non-conductive component includes integrally formed body 106 and tube 110. For example, the non-conductive component can be injected molded as a single integrated component. The conductive components can include electrical contacts 120 that are mounted to body 106. The integral nature of body 106 and tube 110 requires a certain minimum thickness of the non-conductive component in order to form tube 110 of assembly 100. This minimum thickness for tube 110 limits the ability to reduce the size of housing 150. For example, a reduction of z-height thickness of housing 150 is limited due to the minimum thickness needed to form 110.

Figure 2A:
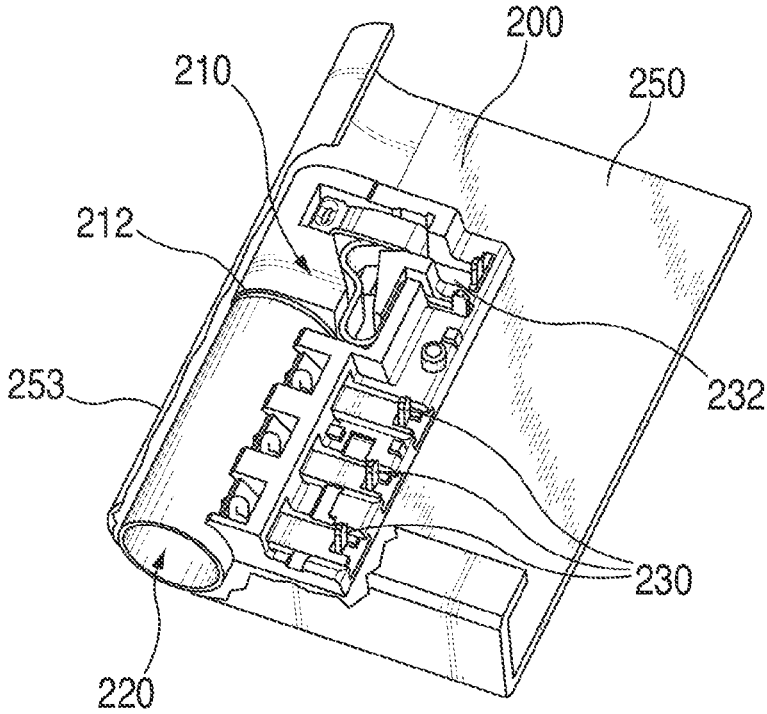
FIGS. 2A-2C shows several views of a split jack assembly in accordance with an embodiment of the invention. in accordance with an embodiment.
Figure 2B:
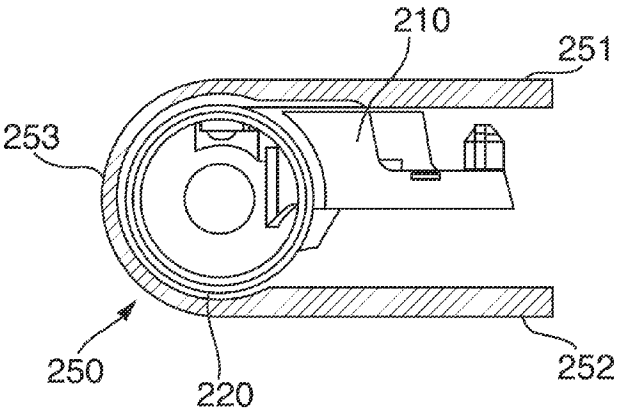
Figure 2C:
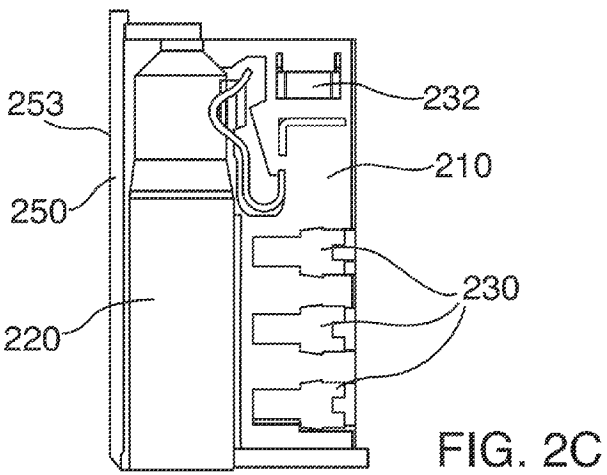

FIGS. 2A-2C shows several views of a split jack assembly in accordance with an embodiment of the invention. FIG. 2A shows an illustrative partial cut-way and isometric view of split jack assembly 200 incorporated into housing 250. FIG. 2B shows a side view and FIG. 2C shows a top view of split jack assembly 200 in housing 250, respectively. Reference will be made to FIGS. 2A-2C collectively. As shown, split jack assembly 200 can include tubeless pin block 210, tube 220, spring-loaded pins 230, and retention pin 232. Tubeless pin block 210 and tube 220 are separate components and are not integrally formed, which is in direct contrast to conventional integrated-tube jack assembly 100 of FIG. 1. Pins 230 and 232 are conductive, but the other parts of pin block 210 are non-conductive. Tube 220 is also non-conductive.

Split jack assembly 200 eliminates the integrated housing of assembly 100, and as a result, is able to reduce its footprint, compared to assembly 100. The reduced footprint can be realized in that the separate pin block 210 and tube 220 construction allows for a thinner housing 250 in the z-height than housing 150. The two part construction of assembly 200 does not require pin block to envelope tube 220, thus eliminating the minimum thickness requirement needed to form tube 110.

Figure 3A:
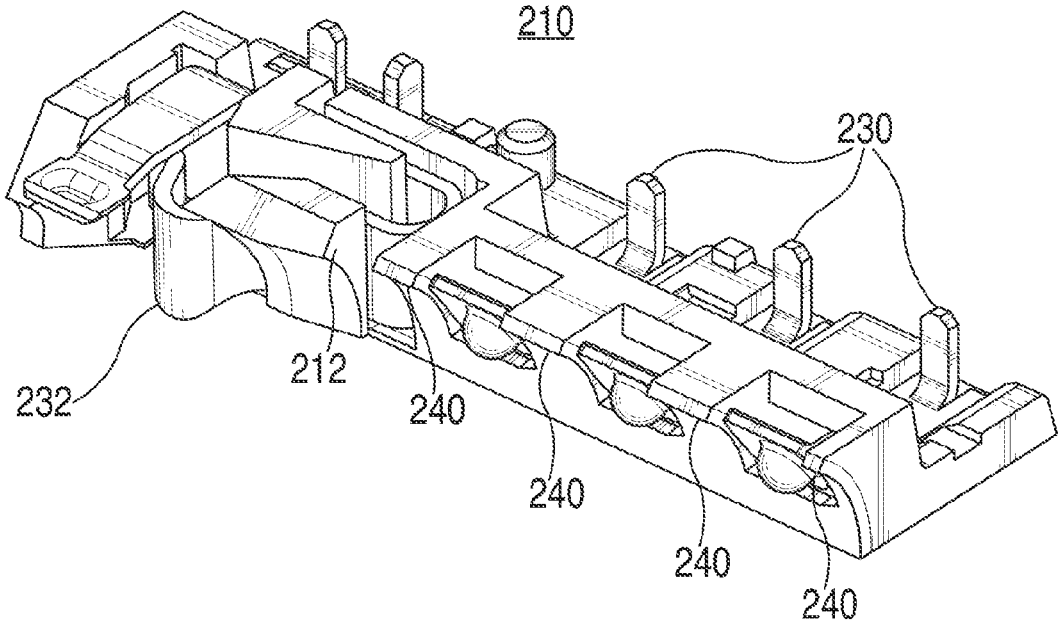
FIGS. 3A-3C show several illustrative views of tubeless pin block in accordance with an embodiment.
Figure 3B:
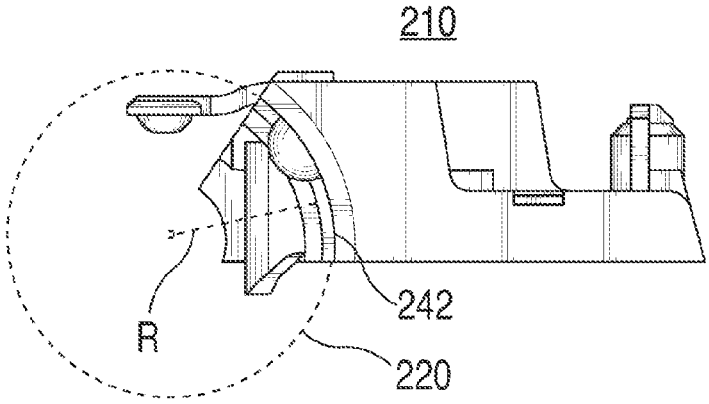
Figure 3C:
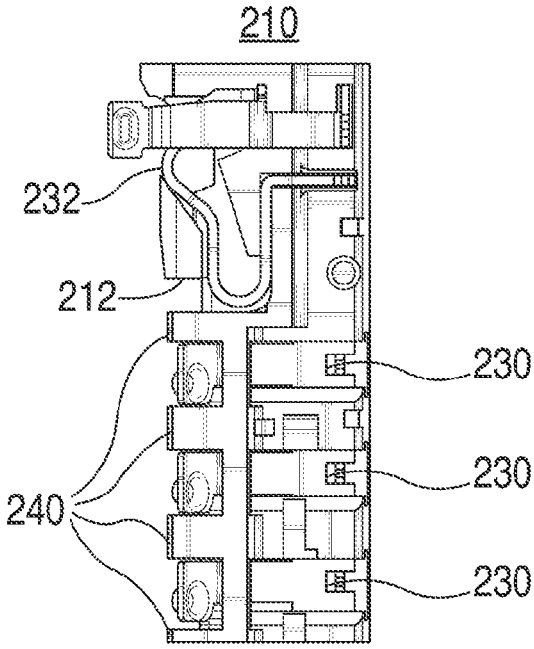

Referring briefly to FIGS. 3A-3C, several illustrative views of tubeless pin block 210 are shown. Tubeless pin block 210 includes curved abutting members 240 that are aligned along curved plane 242 and are interspersed with spring-loaded pins 230. A portion of each spring-loaded pin 230 can protrude beyond curved plane 242. Curved abutting members 240 are curved according to a predetermined radius. The predetermined radius can vary on a few factors such as the diameter of the plug to be inserted in the split jack assembly and/or whether a separate tube (e.g., tube 220) is used.

Block 210 can include tube-stop abutting member 212, which can provide an anchor point for tube 220 if tube 220 is fixed to block 210. Retention pin 232 can hold a plug (not shown) in place when it is inserted into the split jack assembly.

Figure 4A:
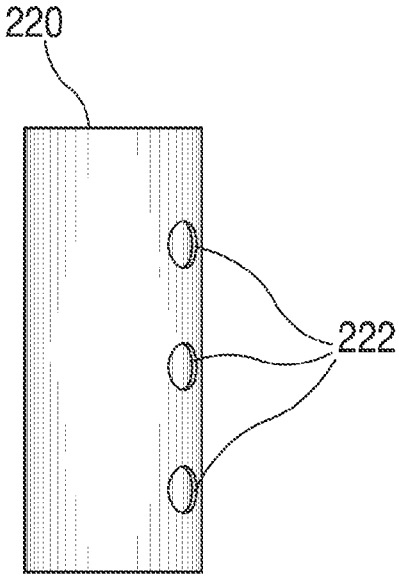
FIGS. 4A-4B show two illustrative views of a tube in accordance with one embodiment.
Figure 4B:
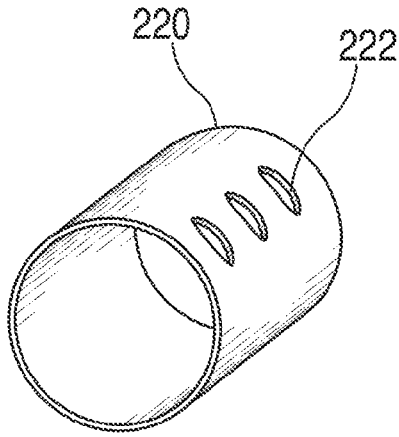

Referring now to FIGS. 4A-4B, two illustrative views of tube 220. As shown, tube 220 can include one or more holes 222. Each hole 222 permit a spring-loaded pin 230 to pass through so that it can come into contact with a region of a plug (not shown). Tube 220 has a predetermined diameter and wall thickness. The wall thickness can range between 50 and 200 um, 75 and 125 um, or be about 100 um. Tube 220 may be an extruded material having non-conductive properties.

Referring back to FIGS. 2A-2BC, tube 220 is shown fixed to tubeless pin block 210. When tube 220 is fixed to block 210, curved abutting members 240 abut the outer surface of tube 220, the edge of tube 220 abuts tube-stop abutting member 212, and each one of spring-loaded pins 230 protrude through one of holes 222. Tube 220 may be fixed to block 210 using any suitable approach, such as, for example, adhesive (e.g., PSA), glue, or press fit. In another approach, block 210 and tube 220 can be subject to elevated temperatures that cause both to partially melt and bond together.

Jack assembly 200 can be positioned adjacent to a side of housing 250. In some embodiments, block 210, tube 220, or both may be secured to housing 250 using glue, adhesive, or other suitable bonding agent or technique. Use of glue, for example, can assist in enhanced strength of jack assembly 200 and can help eliminate ingress of water or debris into the housing 250. Housing 250 can be any multi-walled structure that encloses various components of an electronic device. Some of the walls may be curved, as shown. In particular, side wall 253 is curved and can be integrally formed with first surface member 251 and second surface member 252. The interior surface of sidewall 253 can be curved according to a predetermined radius. Moreover, in some embodiments, the interior surface may be dimensioned so that tube 220 fits snuggly against it when jack assembly 200 is installed in housing 250. In other embodiments, the interior surface of housing 250 may be dimensioned to accommodate a tubeless design (as shown in FIG. 5).

The wall thickness of side wall 253 relative to wall thickness of tube 220 may be substantially greater. For example, the wall thickness of side wall 253 may be 2-10 times greater than the wall thickness of tube 220. Enhanced wall thickness may be necessary because it bears some the lateral load exerted by the plug as it is inserted and retained within jack assembly 200.

Figure 5:
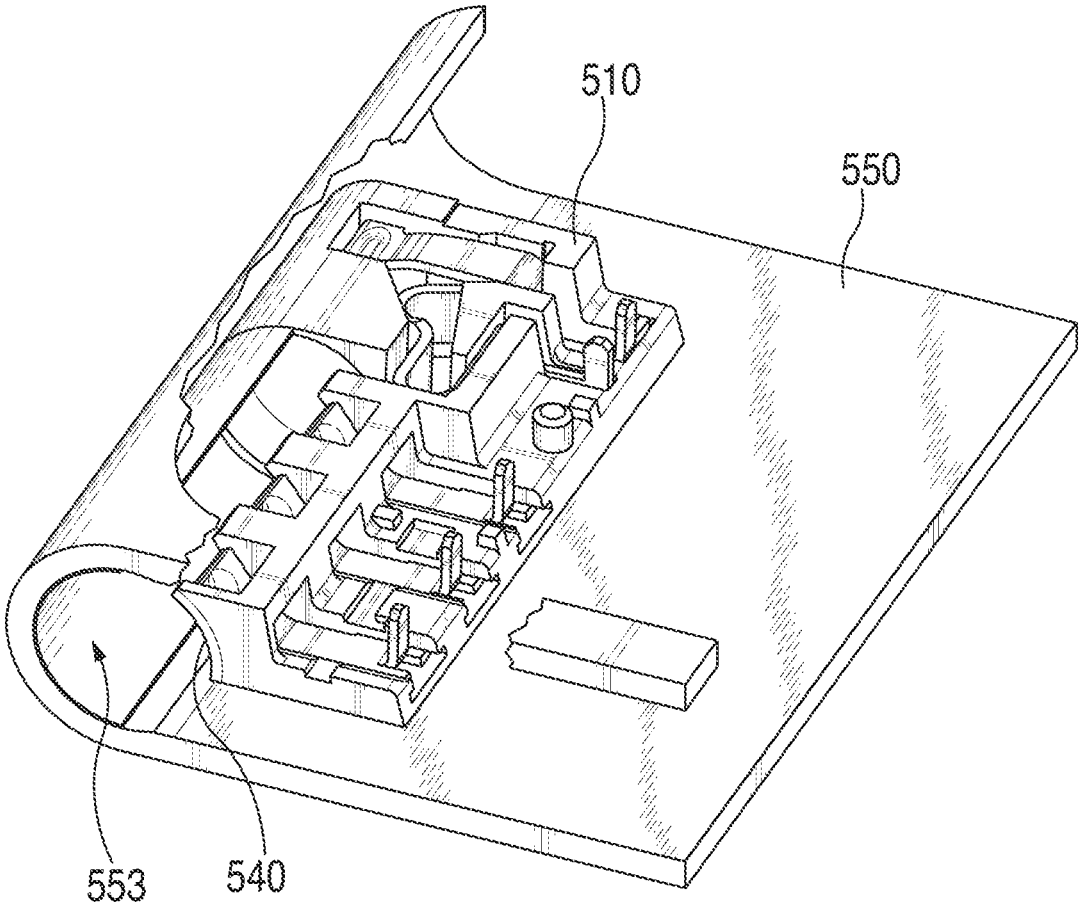
FIG. 5 shows a partial cut-away view of a split jack assembly incorporated inside housing in accordance with an embodiment.

FIG. 5 shows a partial cut-away view of split jack assembly 500 incorporated inside housing 550 in accordance with an embodiment of the invention. Jack assembly 500 can include tubeless pin block 510 and curved inner surface 553. Pin block 510 can be the same or similar to pin block 210, as discussed above. The difference with jack assembly 500, compared to jack assembly 200, is that no separate tube is used as a receptacle for a plug. Rather, inner surface 553 and pin block 510 form the plug receptacle by being appropriately sized and placed together in appropriate proximity of each other. Thus, the radii of curvature of both inner surface 553 and curved abutting members 540 can be substantially the same so that a receptacle of uniform diameter is provided for receiving a plug (not shown).

In some embodiments, depending on the material composition of housing 550, an insulation layer may be applied to inner surface 553. If housing is constructed from metal, the insulation layer will prevent shorts when the plug is inserted. If an insulation layer is applied, then the dimensions of the inner surface are made so that the desired diameter is obtained for the plug receptacle.

The insulation layer may be constructed from any suitable material and applied using any suitable process. For example, a material may be applied using spraying, painting, plasma vapor deposition (PVD), chemical vapor deposition (CVD), plasma enhanced chemical vapor deposition (PECVD), UV curing, high bake curing, thin tube extrusion (e.g., coupled to the housing an adhesive, tape, bonding, or press fit), oxidation, electrolytic deposition, electrostatic deposition, plasma electrolytic oxide (PEO) process, a thermal spray coating, or any other suitable process. Different materials may be used for each of the processes, including for example polyetheretherketone (PEEK), alumina, nitride (e.g., aluminum titanium nitride or silicon nitride), polyphenyl ether (PPE), diamond-like carbon coating (DLC), a plastic, polymer, composite material, or any other suitable material. In some embodiments, thin tube extrusion (e.g., using PEEK), coatings applied by oxidation of the base metal (e.g., oxidation of the housing metal around the periphery of the port), or electrostatic deposition of ceramic coatings may provide adequate insulation on inner surface 653.

The material and process may be selected based on any suitable criteria. In particular, the material may be selected to be isolating (e.g., otherwise, it does not reduce undesired contacts between the connector and housing). Other criteria may include, for example, selecting the material and process based on the appearance of the resulting layer or film (e.g., select a material that is substantially clear or transparent, or a material that is substantially the same color as the housing). As another example, the material and process may be selected based on resistance to cracking, abrasive wear, or other failure (e.g., select a material and process that provide a layer operative to resist to a particular number of cycles of placing and removing a connector within the connector housing, or pulling a connector against the edges of the housing port). As still another example, the material and process may be selected for its applicability to different geometries (e.g., select a process and material that may be applied to ports in flat housings and curved housings).

Figure 6:
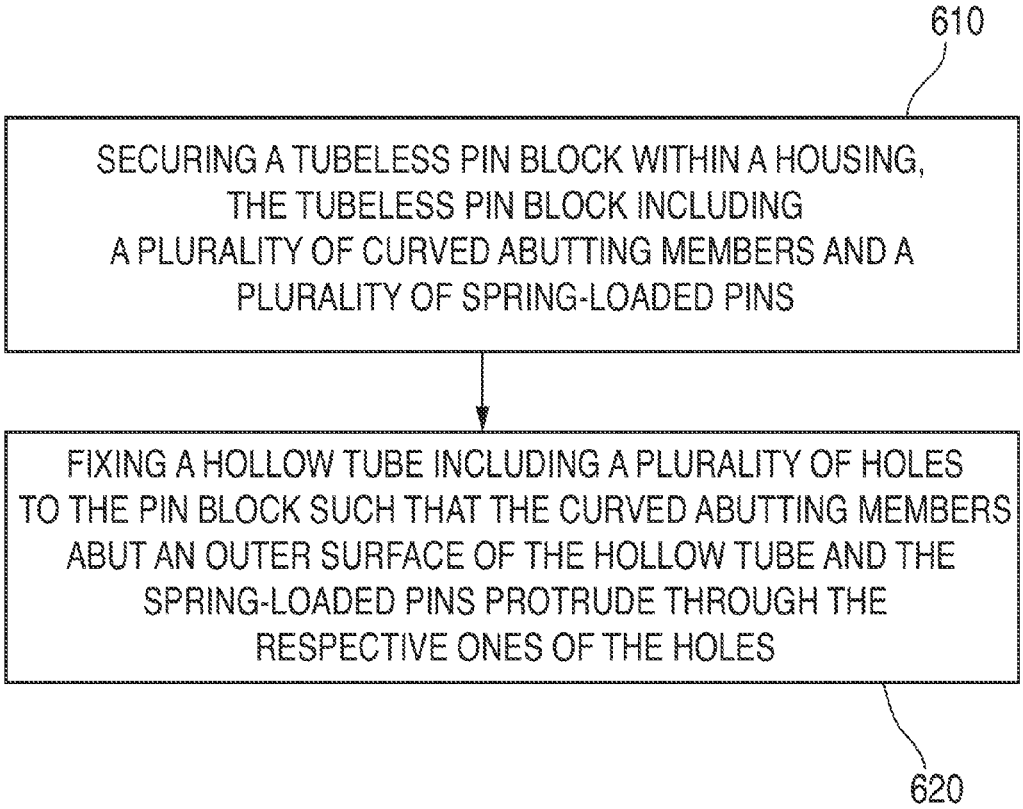
FIG. 6 shows an illustrative flowchart for making a jack assembly in accordance with an embodiment.

FIG. 6 shows an illustrative process for assembling a jack assembly in accordance with an embodiment. Beginning at step 610, a tubeless pin block is secured within a housing, the tubeless pin block including a plurality of curved abutting members and a plurality of spring-loaded pins. For example, the tubeless pin block can be block 210 of FIGS. 2 and 3. At step 620, a hollow tube comprising a plurality of holes is fixed to the pin block such that the curved abutting members abut an outer surface of the hollow tube and the spring-loaded pins protrude through respective ones of the holes. The tube can be tube 220 of FIGS. 4A-4B, for example.

The tube can be secured to the pin block by being inserted into the housing and rotated such that the spring-loaded pins protrude through their respective holes in the tube. The tube may also be inserted into the housing until it abuts a tube-stop abutting member.

Figure 7A:
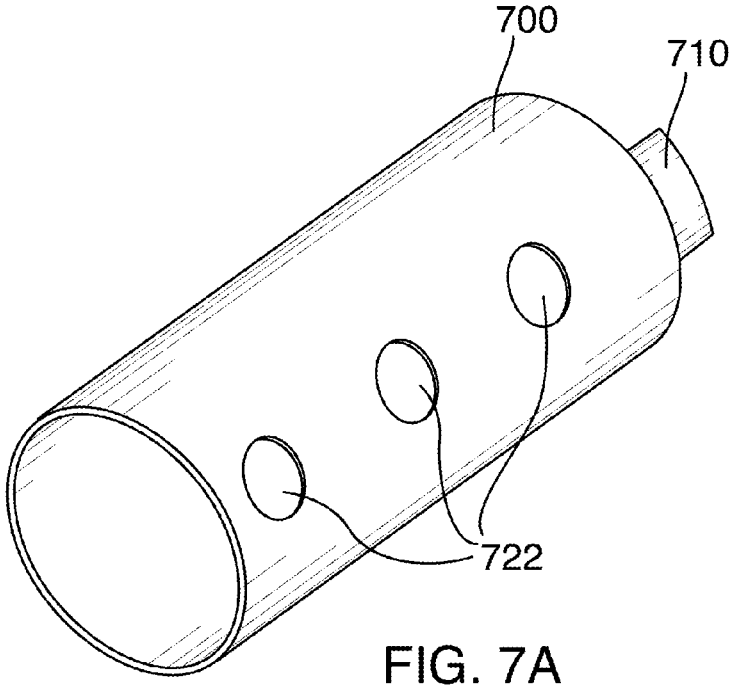
FIGS. 7A-7B and 8A-8B show illustrative interlocking features that can be incorporated into the tube and pin block according to various embodiments.

FIGS. 7A-7B and 8A-8B show interlocking features that can be incorporated into the tube and pin block according to various embodiments. Interlocking features may be useful in securing the tube to the pin block and further enhancing ease of assembly. Referring now to FIG. 7A, tube 700 includes tab 710 and holes 722. Tab 722 can fit into a corresponding slot contained within the pin block (neither of which are shown). The tab/slot combination can assist in preventing tube 700 from rotating after it is installed. If desired, an adhesive can be used to glue tab 710 within the slot.

Figure 7B:
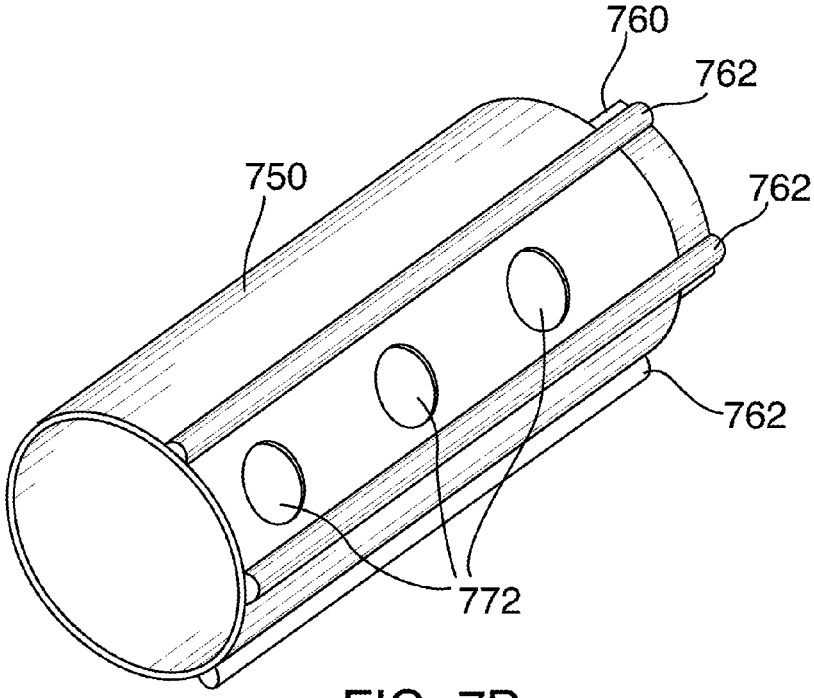

FIG. 7B shows tube 750 including tab 760, ribs 762, and holes 772. Tab 760 can fit into a corresponding slot in a manner similar to tab 710 (of FIG. 7A). Ribs 762 can run along the length of tube 750, and in some embodiments, can also run along tab 760. Any number of ribs can be incorporated into tube 750. Thus, although three ribs are shown in the FIG., fewer or additional ribs can be incorporated. Ribs 762 can fit into channels that run along the pin block (both of which are not shown). When ribs 762 are engaged with their respective channels in the pin block, the rib/channel combination is effective in preventing tube 750 from rotating, and it can facilitate ease of assembly. In some embodiments, use of tab 760 can be omitted and the tube can rely on use of ribs 762 to prevent rotation of tube 750.

It is understood that the interlocking features can be reversed. For example, the slot can exist on the tube and the tab member can exist in the pin block. As another example, the channels can exist on the tube and the ribs can exist on the pin block.

Figure 8A:
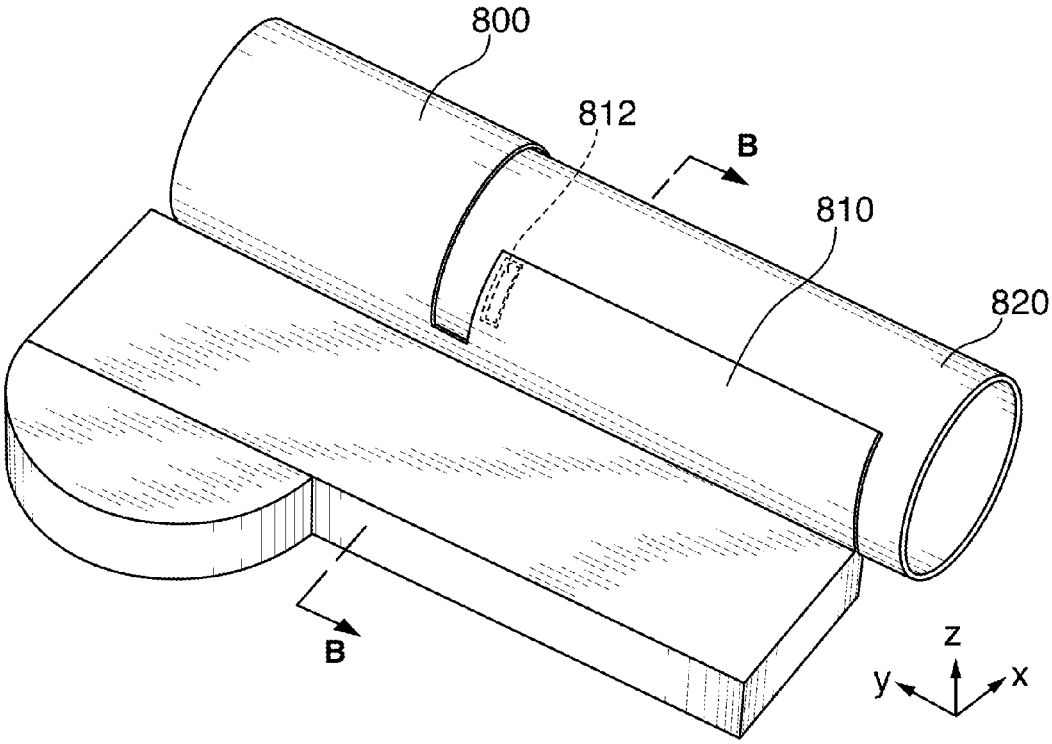
Figure 8B:
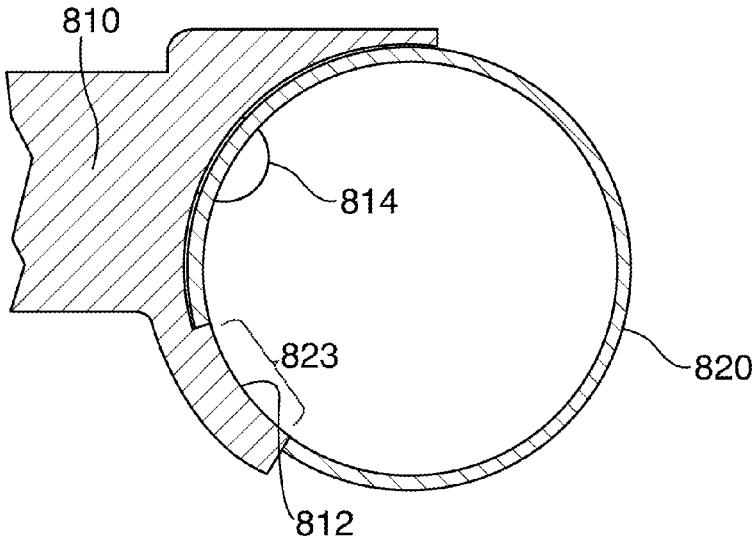

FIG. 8A shows an illustrative perspective view of pin block 800 with tube 820 attached thereto in accordance with an embodiment. FIG. 8B shows an illustrative cross-sectional view taken along line B-B of FIG. 8A. Reference will be made to FIGS. 8A-8B collectively. Pin block 800 includes, among other features, curved member 810, tab member 812, and pins 814. Tube 820 can includes holes (not shown) and slot 823. Tab member 812 is part of curved member 810 and is constructed to fit into slot 823 when tube 820 is positioned next to pin block 800. The combination of tab member 812 and slot 823 can prevent tube 820 from rotating and sliding in the y-axis direction. In some embodiments, curved member 810 is can be attached to the outer surface of tube 820 with an adhesive.

Referring specifically to FIG. 8B, the surface of tab member 812 is dimensioned to match the radius of tube 820. Thus, even though tab member 812 is inserted into a slot (not shown) contained within tube 820, the inner diameter of tube 820 remains substantially constant.

It is understood that the tab member and slot can be reversed. For example, the tube can include a tab member operative to fit into a slot contained in the curved member.

The above described embodiments of the invention are presented for purposes of illustration and not of limitation, and the present invention is limited only by the claims which follow.

What is claimed is:

1. A jack assembly for use with a plug, the jack assembly comprising:

a tubeless pin block comprising:

a plurality of curved abutting members; and a plurality of spring-loaded pins, each spring-loaded pin positioned within one of the curved abutting members and operative to protrude beyond a curved plane formed by the curved abutting members; and a hollow tube including a plurality of holes and fixed to the pin block such that the curved abutting members abut an outer surface of the hollow tube and the spring-loaded pins protrude through respective ones of the holes.

2. The jack assembly of claim 1, wherein the tube is constructed from a non-conductive material.

3. The jack assembly of claim 1, wherein the curved abutting members are constructed from a non-conductive material.

4. The jack assembly of claim 1, wherein the tubeless pin block comprises a retention pin.

5. The jack assembly of claim 1, wherein the tubeless pin block comprises a tube-stop abutting member, and wherein an end of the hollow tube abuts the tube-stop abutting member.

6. The jack assembly of claim 1, wherein the tubeless pin block and hollow tube are separate components that are not integrally formed together.

7. The jack assembly of claim 1, further comprising:

a housing having a curved surface, wherein the tube is secured to the curved surface of the housing.

8. An electronic device, comprising:

a housing having first and second surface members joined together by a curved side member, the curved side member having a predetermined radius;

a pin block secured within the housing adjacent to the side member, the pin block including:

a plurality of curved abutting members each having a radius that is substantially the same as the predetermined radius; and a plurality of spring-loaded pins, each spring-loaded pin positioned within one of the curved abutting members and operative to protrude beyond a curved plane formed by the curved abutting members;

wherein the curved side member and the curved abutting members form part of a plug receptacle.

9. The electronic device of claim 8, wherein the housing is constructed from a conductive material.

10. The electronic device of claim 9, wherein an inner surface of the curved side member comprises a non-conductive insulation layer.

11. The electronic device of claim 10, wherein the non-conductive layer is a plastic or diamond-like carbon.

12. The electronic device of claim 10, wherein the non-conductive layer is a liner material.

13. The electronic device of claim 8, wherein a portion of the pin block is secured to the curved side member.

14. A method for manufacturing a jack assembly, the method comprising:

securing a tubeless pin block within a housing, the tubeless pin block comprising a plurality of curved abutting members and a plurality of spring-loaded pins; and fixing a hollow tube comprising a plurality of holes to the pin block such that the curved abutting members abut an outer surface of the hollow tube and the spring-loaded pins protrude through respective ones of the holes.

15. The method of claim 14, wherein the housing comprises a curved surface, and a portion of the outer surface of the hollow tube is secured to the curved surface.

16. The method of claim 14, wherein fixing a hollow tube to the pin comprises:

inserting the hollow tube into the housing; and rotating the hollow tube until the spring-loaded pins protrude through their respective holes.

17. The method of claim 14, further comprising:

inserting the hollow tube member into the housing until it abuts a tube-stop abutting member of the tubeless pin block.

18. The jack assembly of claim 1, wherein the pin block comprises a slot, and wherein the tube comprises a tab operative to fit into slot.

19. The jack assembly of claim 1, wherein the pin block comprises at least one channel, and wherein the tube comprises at least one rib operated to fit within its respective at least one channel.

20. A jack assembly for use with a plug, the jack assembly comprising:

a tubeless pin block comprising:

a curved member having a tab member incorporated therein; and a plurality of spring-loaded pins; and a hollow tube including a plurality of holes and a slot, the hollow tube fixed to the pin block such that the curved member abuts an outer surface of the hollow tube, the tab member fits within the slot, and the spring-loaded pins protrude through respective ones of the holes.

* * * * *